US006253958B1

(12) United States Patent
Coletti

(10) Patent No.: US 6,253,958 B1
(45) Date of Patent: Jul. 3, 2001

(54) METHOD AND DEVICE FOR MULTI-CAPPED PASTE DISPENSER

(76) Inventor: Theodore R. Coletti, 47 Goodwin Ave., S.I., NY (US) 10314

( * ) Notice: Subject to any disclaimer, the term of this patent is extended or adjusted under 35 U.S.C. 154(b) by 0 days.

(21) Appl. No.: 09/362,574

(22) Filed: Jul. 28, 1999

(51) Int. Cl.[7] ..... G01F 11/00
(52) U.S. Cl. ..... 222/1; 222/92; 222/482
(58) Field of Search ..... 222/1, 92, 94, 222/481, 482

(56) References Cited

U.S. PATENT DOCUMENTS 2,921,716 * 1/1960 Schiller ..... 222/92
3,591,053 * 7/1971 Thomas ..... 222/92

FOREIGN PATENT DOCUMENTS

168164 * 4/1951 (AT) ..... 222/92

* cited by examiner

*Primary Examiner*—Joseph A. Kaufman

(74) *Attorney, Agent, or Firm*—Mary A. Whiting Patent Attorney

(57) ABSTRACT

A dispensing device for viscous pastes, for multiple users, which deploys a plurality of color coded caps for their personal identification and use. The device is screwed onto a squeezable tube of paste (for example, toothpaste), and, as the tube is squeezed, the paste flows through the device, past caps in a "closed" position, and out of a desired number of caps in an "open" position, in order to dispense paste. The caps' conduits are of a predetermined circumference for dispensing the desired amount of the paste. A smaller circumference is more economical, as less paste would flow out of such a conduit. This would be especially useful when the users are children. Threaded or friction-fitting cap tops may be attached to the device. If attached by friction-fitting, the cap tops form orbital lips to ensure a tight frictional fit to the cap necks. Connecting bands link the dispensing cap tops to the device, so that the tops won't be lost. The device can be attached to various sized squeezable tubes by a threaded connector cap. The diameter and thread gauge of the connector cap is of a predetermined diameter and gauge, for matching diameters and thread gauges of squeezable tubes. The device is preferably composed of plastic material, which is easily cleanable, sanitary, as well as inexpensive to manufacture.

16 Claims, 3 Drawing Sheets

METHOD AND DEVICE FOR MULTI-CAPPED PASTE DISPENSER

BACKGROUND

1. Field of Invention

The present invention relates to dispensers for squeezable tubes containing viscous pastes, and more particularly, pertains to a new and improved dispenser and method for dispensing pastes, wherein the same utilizes a plurality of color coded dispensing caps selected by the users to designate their personal caps in order to provide for sanitary, economical dispensement of paste. The device is easily cleaned and reusable as it can be reattached to various sized squeezable tubes once their contents are depleted and a new full tube is desired. Certain dental products, cosmetics, medicinal creams, or any product for personal use by different users, may be benefited by the structure and sanitary qualities of the invention.

2. Description of Prior Art

Containers of various structures, with a single or plurality of chambers, and varied dispensing methodologies, are present in the prior art. However, none of the prior art references encompass a structure or method similar to the present invention. The present invention is not a system but rather an integrated, disposable, interchangeable device to be attached to a squeezable tube. The multi-capped, color-coded structure of the present invention, will enable various users to use the same tube while minimizing the potential for cross-contamination. The device can be attached to various sized tubes, due to the threaded connecting cap having a predetermined diameter and thread gauge for matching varied tubes' dimensions. Examples of the prior art include the following U.S. Pat. Nos.:

| | | |
|---|---|---|
| Smith | U.S. Pat. No. 5,794,819 | Issued August 18, 1998 |
| Matt | U.S. Pat. No. 5,765,725 | Issued June 16, 1998 |
| Iaia, et. al. | U.S. Pat. No. 5,318,204 | Issued June 7, 1994 |
| Singh | U.S. Pat. No. 5,062,550 | Issued November 5, 1991 |
| Green | U.S. Pat. No. 4,984,715 | Issued January 15, 1991 |
| Britt, et. al. | U.S. Pat. No. 4,754,898 | Issued July 5, 1988 |
| Watt | U.S. Pat. No. 4,150,673 | Issued April 24, 1979 |
| Simmons | U.S. Pat. No. 4,148,417 | Issued April 10, 1979 |

U.S. Pat. No. 5,062,550, (Singh), discloses a device with divided container walls, and a deformable memory retentent container cap which accommodates varying conduit flow rates to permit selective dispensing its contents. This differs from the present invention, since the present invention has one non-compartmentalized tubular frame, which allows for a reduced amount of paste for economical use, while Singh is concerned with flow rates through conduits to permit selective dispensing of the contents of its container.

In addition to U.S. Pat. No. 5,062,550, (Singh), the prior art has also described containers that separate contents by placing the contents in different or dual chambered compartments. For instance, U.S. Pat. No. 4,148,417, (Simmons), U.S. Pat. No. 5,765,725, (Matt), U.S. Pat. No. 5,794,819, (Smith), U.S. Pat. No. 5,318,204; (Iaia, et. al.), and U.S. Pat. No. 4,984,715, (Green) have dual compartment structures which are distinguished from the present invention.

Further, U.S. Pat. No. 4,754,898, (Britt, et. al.), describes different sized orifices, wherein the smaller orifice provides for a venting function. In the present invention, the smaller sized dispensing conduits provide for economical paste use, and thus, its purpose differs from that of Britt.

U.S. Pat. No. 4,150,673, (Watt), references the concept of coding the caps. However, in Watt, the coding is for puncturing a sealed cap; it is not for several or different users. Watt's caps are coded by being differently shaped. Since the present invention's coding is based on color not shape, it is distinguished from Watt. Although Watt discusses health safety, Watt differs from the present invention in that multiple users are disallowed. The present invention's purpose is specifically for multiple users.

OBJECTS AND SUMMARY OF THE INVENTION

Accordingly, an object of the present invention is to provide for a multi-capped device to be utilized by various users, while maintaining the sanitary integrity of the device by utilizing color-coded dispensing cap tops and necks.

Another object of the present invention is to provide for home, as well as professional use, whenever the need for minimization of cross-contamination is desired.

Still another object of the present invention is to provide for a device wherein the amount of paste could be decreased for economical use of the paste.

Yet still another object of the present invention is for inexpensive manufacture of a device composed of conventional plastic material which can withstand normal wear.

Still yet still another object of the present invention is to provide for an easily cleanable invention.

Yet still another object of the present invention is to provide for easily removable and detachable caps.

Finally, still yet another object of the invention, preferably for professional use, is to provide for a dispensing device which creates multiple dispensement of approximately equal amounts of paste.

In accordance with the foregoing objects, the multi-capped dispensing device, comprises a cylindrically shaped hollow tubular frame, having a plurality of dispensing cap members with tops and necks forming conduits, for dispensing paste. The cylindrically shaped hollow tubular frame also comprises a threaded connecting cap, located opposite the dispensing cap members, and linearly aligned along the longitudinal axis of the cylindrically shaped hollow tubular frame, which attaches the device to the squeezable tube by conventional thread means. The threaded connecting cap has two sets of threads: inner threads which attach to the tube's threaded neck, and outer threads which attach to the cylindrically shaped hollow tubular frame's threaded conduit. Connecting caps can be manufactured with inner threads having a predetermined diameter and thread size, to match the range of diameter and thread size of various tubes. Thus, the invention can be interchangeable with different sized tubes.

Once the device is attached to the squeezable tube, the tube is squeezed so that its contents will flow through the tube's and threaded connecting cap's conduits, through the cylindrically shaped hollow tubular frame, past dispensing cap members which are in a closed position, and out of a desired number of dispensing cap neck's conduits which are in an open position. The device can preferably accommodate up to five dispensing cap members, with two positioned on the ends of the cylindrically shaped hollow tubular frame, and the remainder linearly aligned appositionally to each other along the longitudinal axis of the cylindrically shaped hollow tubular frame, and opposite the threaded connecting cap, which is similarly aligned along the longitudinal axis. After the desired amount of paste is dispensed, the user reattaches the dispensing cap top to be ready for the next user.

A plurality of color coded cap members provide for sanitary, economical dispensement of paste. The device is composed of a conventional plastic, which can be easily cleaned. It is also reusable and can withstand normal wear, as it can be detached from various sized squeezable tubes once empty and reattached to a new full tube. Certain dental products, medicinal creams, and cosmetics (or any products for personal use by different users) may benefit from the structure and sanitary qualities of the invention. The color coding of the dispensing cap members maintains the integrity of the sanitary condition of the device, since the users will distinguish their dispensing cap members from the previous users' by the color coding, thus ensuring that numerous users will not use each other's dispensing cap members. The entire dispensing cap member may be color coded, or the neck and the inside of the dispensing cap top may be color coded. If the inside of the dispensing cap top is color coded, this allows for a "clean appearance", as the surface of the device would appear white when not in use. Color coding is especially useful when the device is used in the health care profession, or home use, where minimization of cross-contamination is an essential requirement. Geared preferably for professional use, the invention can dispense approximately equal amounts of paste through a plurality of dispensing cap neck conduits. While for home use, the device can dispense one steady stream of paste from a single dispensing cap neck's conduit.

REFERENCE NUMBERS IN THE DRAWINGS

1 Device

2 Squeezable tube

3 Threaded neck of squeezable tube

Figure 1:
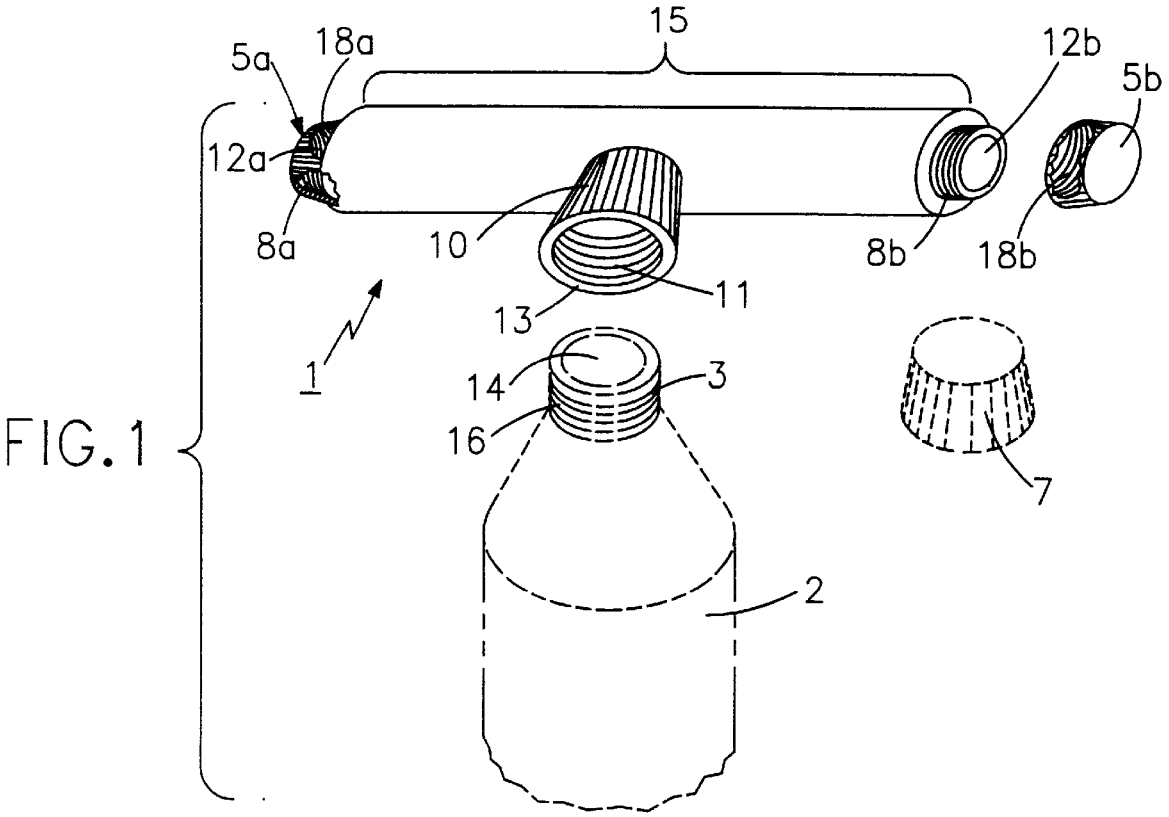
FIG. 1., is a perspective view of the invention, showing two threaded dispensing caps members, with one cap open and the other closed (shown in breakaway with threads exposed), in the process of attaching the invention to a squeezable tube, (shown in phantom and collapsed view).

4 Threads of cylindrically shaped hollow tubular frame's conduit

5 *a, b, c, d, e, f, g* Dispensing cap tops

6 Outer threads of threaded connecting cap

7 Threaded cap top of squeezable tube

8 *a, b, c, d, e, f, g* Dispensing cap necks

9 *e, f, g* Connecting Bands

10 Threaded connecting cap

11 Inner threads of threaded connecting cap

12 *a, b, c, d, e, f, g* Conduits of dispensing cap necks

13 Conduit of threaded connecting cap

14 Conduit of squeezable tube's threaded neck portion

15 Cylindrically shaped hollow tubular frame

16 Threads of squeezable tube's neck

17–17' Longitudinal axis of cylindrically shaped hollow tubular frame

18 *a, b, c, d*, inner threads of dispensing cap tops

19 *e, f, g* Orbicular lips of dispensing cap tops

DESCRIPTION OF THE PREFERRED EMBODIMENT OF INVENTION

The present invention shall now be described in detail with the aid of several specific embodiments utilizing FIGS. 1–4. As shown in FIG. 1., the present invention 1 comprises a multi-capped dispenser (with two threaded dispensing cap tops 5*a* and 5*b*) attached to dispensing cap necks 8*a* (shown in breakaway) and 8*b*, and with a central threaded connecting cap 10, having a predetermined diameter and inner thread 11 gauge, for threadedly securing the threaded neck 3 of a conventional squeezable tube 2, (shown in phantom and collapsed view) once threaded cap top 7 (shown in phantom) is removed, to the central threaded connecting cap 10. Inner threads 11 of the central threaded connecting cap 10, and threads 16 of the squeezable tube 2 are of the same diameter and thread gauge in order to ensure a secure fit.

Figure 2:
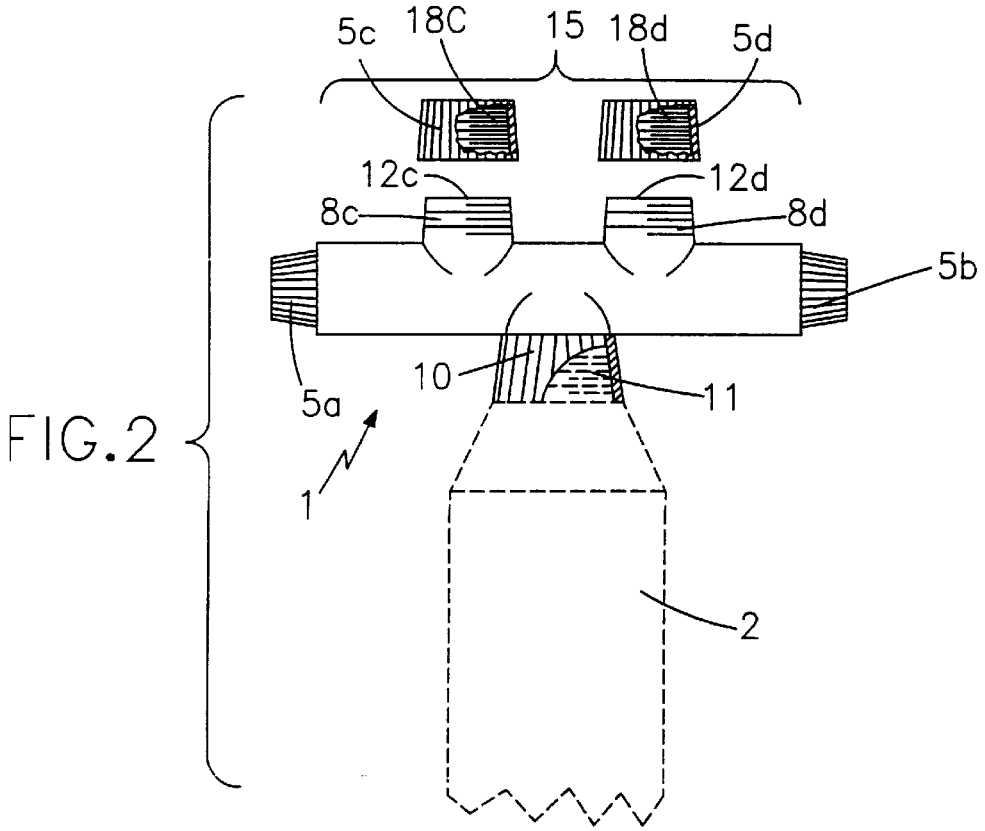
FIG. 2., is a perspective view of the invention, showing four threaded dispensing cap members; the two open cap members used to create equal streams of paste, while the other cap members are closed, and the central threaded connecting cap (shown in breakaway exposing its inner threads) attached to the neck of the squeezable tube (shown in phantom and collapsed view).

Once the central threaded connecting cap 10 is rotatably secured to the squeezable tube 2, (as shown in FIG. 2.), it is further illustrated in FIG. 1., that it is squeezed so that its contents will flow though conduit 14 of the squeezable tube's threaded neck 3, through conduit 13 of the central threaded connecting cap 10, and through the cylindrically shaped hollow tubular frame 15 of the invention. If threaded dispensing cap top 5*a* is closed, and threaded dispensing cap top 5*b* is open, the viscous paste will flow through the cylindrically shaped hollow tubular frame 15, past the closed threaded dispensing cap top 5*a* paste dispensing cap conduit 12*a* (shown in breakaway), and out of the open threaded dispensing cap neck 8*b*, through its conduit 12*b*.

Once the user is finished applying the paste onto a toothbrush or other chosen object, (depending on the tube's contents and desired use) the threaded dispensing cap top 5*b* can be closed by threadedly attaching it to the device by rotatably securing threaded dispensing cap top 5*b* to threaded dispensing cap neck 8*b*. The threaded dispensing cap necks 8*a*, (8*a* is shown in breakaway since the dispensing cap is closed) and 8*b*, and inside threads 18*a*, (18*a* shown in breakaway) and 18*b*, (18*b* is shown in breakaway since it is inside cap top 5*b*), of the dispensing cap tops 5*a* and 5*b*, are color coded, so that various users will know which dispensing cap top is dedicated for their use; which maintains the sanitary integrity of the invention for future users. This will give a "clean" appearance to the invention, as only it's white outer surface will show when not in use. In the alternative, the entire cap tops 5*a* and 5*b*, both inside and out may be color coded to match the dispensing cap necks 8*a* (shown in breakaway and 8*b*).

FIG. 2., illustrates an alternate embodiment of the invention, wherein a plurality of dispensing cap members, (preferably from two up to four), may be deployed by the device, to accommodate from two to up to four users. FIG. 2., shows device 1with two detached threaded dispensing cap tops 5*c* and 5*d*, exposing two open threaded cap necks 8*c* and 8*d*, with cap neck conduits 12*c* and 12*d*, and two attached dispensing cap tops 5*a* and 5*b*, located at the ends of the cylindrically shaped hollow tubular frame 15. This configuration is geared more to professional use, wherein approximately equal amounts of dispensed paste would be desired. FIG. 2., also shows the threaded connecting cap 10, with inner threads 11 shown in breakaway, attached to squeezable tube 2. The same method as described above is employed to attach the device 1 to squeezable tube 2, and dispense the paste out of the open threaded cap neck conduits 12*c* and 12*d*. Inside threads 18*c* and 18*d* are shown in breakaway, since they are inside dispensing cap tops 5*c* and 5*d*, respectively.

Figure 3:
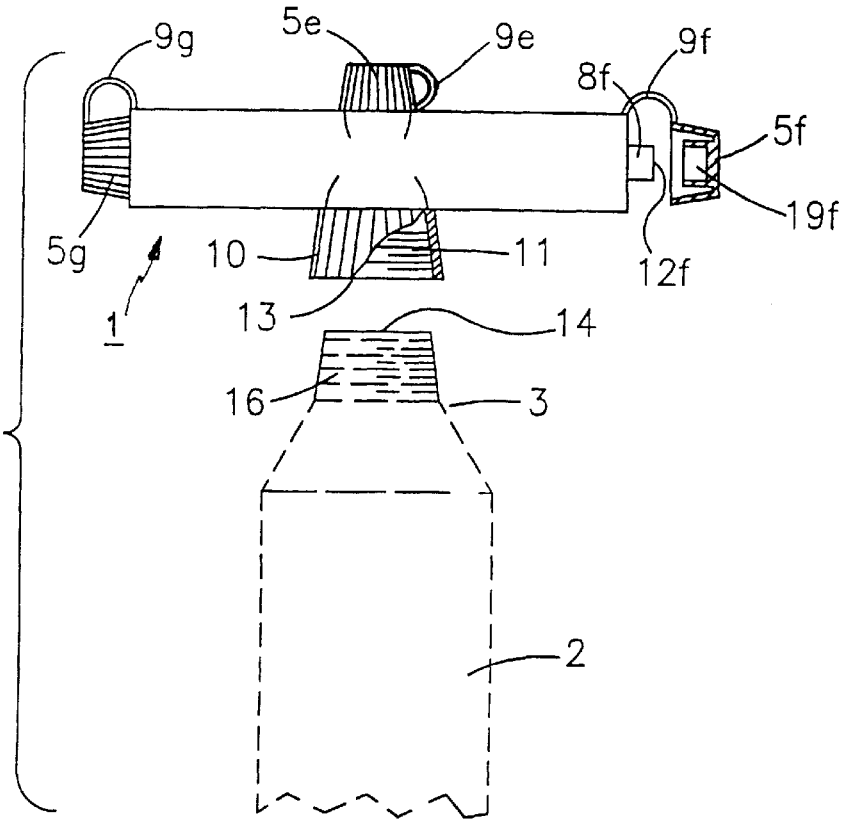
FIG. 3., is a perspective view of an alternate embodiment of the invention, showing three unthreaded dispensing cap members, the open dispensing cap neck's conduit of a smaller circumference, for economical paste use, and dispensing cap top forming an orbicular lip (shown in cross-sectional view), and other two dispensing cap members closed, with a connecting band linking the cap tops and necks.
Figure 5:
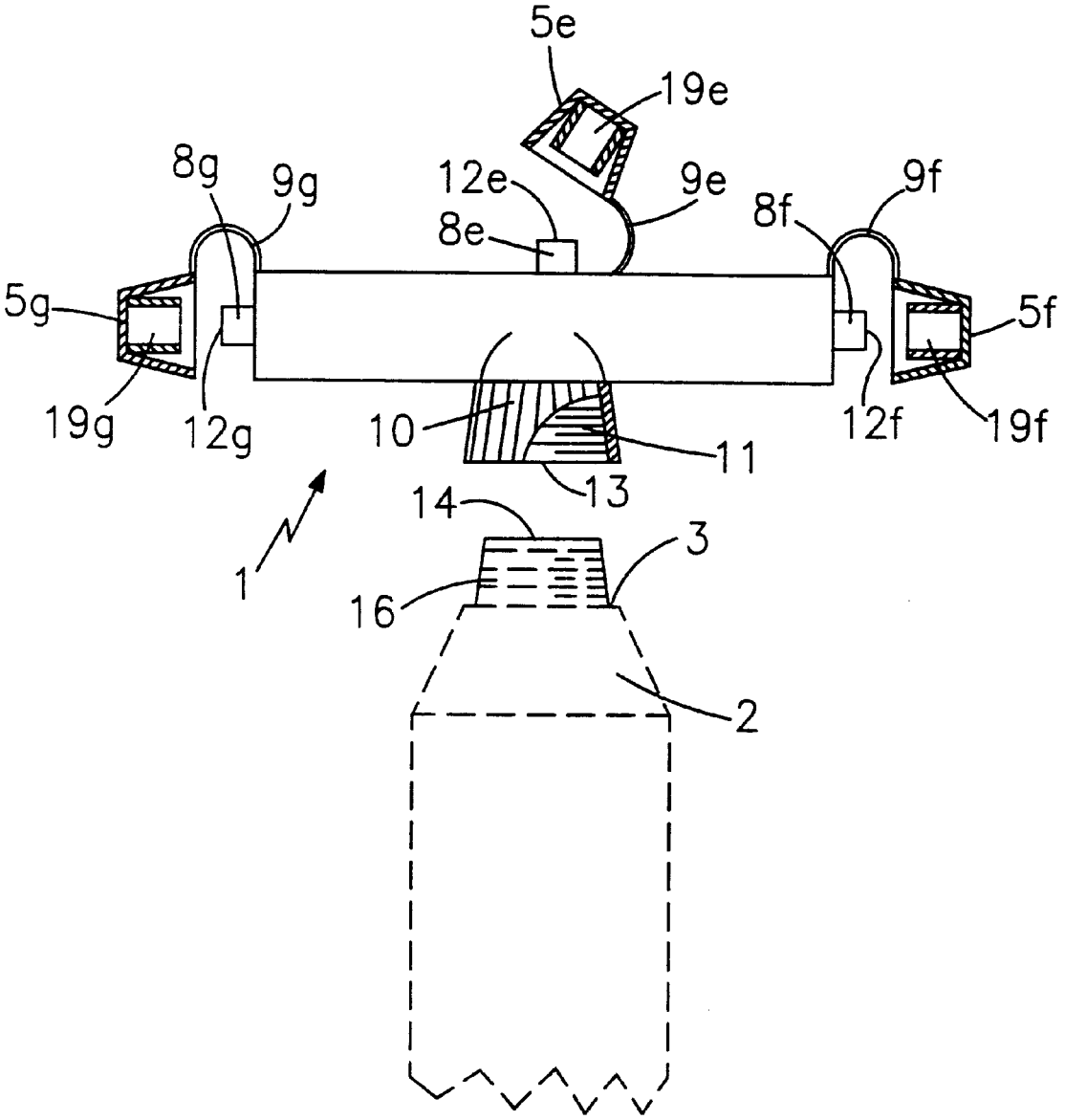
FIG. 5., is a perspective view of the invention, showing three unthreaded dispensing cap members in open position.

FIG. 3., FIG. 5., illustrate yet a further alternative embodiment of the invention, wherein the cap tops are frictionally attached to the cap necks, by conventional snap means, rather than threadedly attached in FIG. 3., unthreaded dispensing cap tops 5*e* and 5*g* are frictionally attached to the corresponding dispensing cap necks 8*e* and 8*g* (not shown since the caps are attached). Unthreaded dispensing cap top 5*f*, is unattached to its corresponding unthreaded cap neck 8*f*. In order to attach dispensing cap top 5*f*, to its corresponding cap neck 8*f*, it is frictionally pushed onto unthreaded cap neck 8*f*, and a flexible orbicular lip 19*f* (shown in cross-sectional view) formed within the dispensing cap top 5*f*, enhances this frictional engagement. Various other types of conventional structures may be formed from either the neck or the cap to similarly enhance this frictional engagement. While the plurality of unthreaded dispensing cap tops frictionally attach to the device 1, the central threaded connecting cap 10 threadedly attaches to the squeezable tube 2, as previously described. Connecting bands 9*e*, 9*f* and 9*g*, join unthreaded dispensing cap tops 5*e*, 5*f* and 5*g* to the device 1 in order for them not to be accidentally lost. Additionally, the amount of the paste may be decreased by decreasing the predetermined circumference of dispensing conduit 12*e*, 12*g*, for economical paste use. This is especially useful if the user is a child. A smaller conduit circumference can also be deployed on threaded cap members to decrease the amount of paste.

Figure 4:
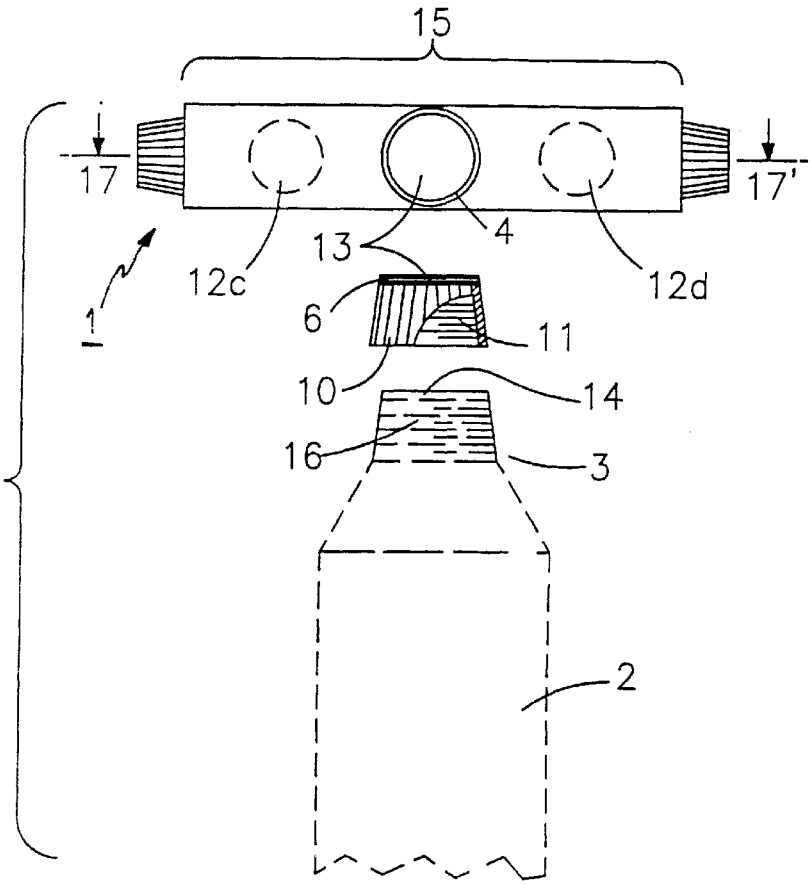
FIG. 4., is a perspective view of the invention, showing, the threaded connecting conduit's position to dispensing cap members'conduits (shown in phantom); linearly aligned along the longitudinal axis 17–17', as well as its relationship to the squeezable tube's neck conduit (shown in phantom and collapsed view).

As shown in FIG. 4., the device 1 can be connected to various sized squeezable tube necks 3, having predetermined diameter and thread gauge 16, since various threaded connecting caps 10, having a predetermined diameter and inner thread 11 gauge, (shown in breakaway) can be interchanged by threadedly securing the different sized threaded connecting caps 10 (comprising outer threads 6) to the cylindrically shaped hollow tubular frame's threaded conduit 13 (comprising threads 4) and thus matched to various sized tubes. FIG. 4., further illustrates that the cylindrically shaped hollow tubular frame's 15 threaded connecting conduit 13 is located opposite the dispensing cap conduits 12*c* and 12*d* (shown in phantom) which are linearly aligned along longitudinal axis 17–17' of the cylindrically shaped hollow tubular frame 15.

As shown in FIG. 5., dispensing caps 5*e*, 5*f* and 5*g* are open, exposing corresponding unthreaded cap necks 8*e*, 8*f* and 8*g*.

I claim:

1. A method for dispensing viscous pastes from conventional squeezable tubes having a threaded cap member, said threaded cap member further comprising a threaded cap top and a threaded neck forming a conduit, utilizing a paste dispensing device comprised of:

a cylindrically shaped hollow tubular frame, employing a plurality of dispensing cap members having dispensing cap tops attached to dispensing cap necks forming dispensing conduits, positioned along the longitudinal axis and lateral axis with respect to the length of said cylindrically shaped hollow tubular frame;

said cylindrically shaped hollow tubular frame further comprising a threaded connecting conduit centrally positioned on said longitudinal axis of said cylindrically shaped hollow tubular frame, and opposite said plurality of dispensing cap members; and a threaded connecting cap member forming a conduit, said connecting cap member having inner and outer threads, wherein said paste is dispensed by use of a method comprising the following steps:

unscrewing said conventional squeezable tube's threaded cap top, from said conventional squeezable tube's threaded neck, for exposing said squeezable tube neck's conduit;

threadedly connecting said threaded connecting cap member's outer threads to said cylindrically shaped hollow tubular frame's threaded connecting conduit;

threadedly connecting said treaded connecting cap member's inner threads to said conventional squeezable tube's threaded neck;

opening a desired number of dispensing cap members by removing a desired number of said plurality of dispensing cap tops from said cylindrically shaped hollow tubular frame; for exposing a corresponding desired number of said dispensing cap necks forming dispensing conduits; and squeezing said squeezable tube wherein said paste flows:

through said squeezable tube's neck's conduit, through said threaded connecting cap's conduit, through said cylindrically shaped hollow tubular frame's threaded connecting conduit, through said cylindrically shaped hollow tubular frame, past said plurality of attached dispensing cap members, towards said desired number of detached dispensing cap members and, out of sad desired number of dispensing cap necks' conduits; whereby said paste is dispensed from said dispensing device.

2. A method, according to claim 1, wherein said plurality of dispensing caps members are threaded, for threadedly securing said threaded dispensing cap tops to said threaded dispensing cap necks.

3. A method, according to claim 1, wherein said plurality of dispensing cap members are unthreaded, further comprising unthreaded cap tops and unthreaded cap necks, for friction fitting said unthreaded dispensing cap tops to said unthreaded dispensing cap necks; said unthreaded dispensing cap tops further comprising orbicular lips to enhance said frictional fit.

4. A method, according to claim 3, wherein said unthreaded dispensing cap tops and unthreaded dispensing cap necks are linked by a connecting means, comprising a flexible band, for ensuring that said unthreaded dispensing cap tops shall not be lost.

5. A method, according to claim 1, wherein said dispensing cap necks' conduits having a predetermined circumference for decreasing the dispensed amount of said paste, for economical dispensement of said paste.

6. A method, according to claim 1, wherein said inner threads of said threaded connecting cap having a range of predetermined diameter and thread gauge, for matching various sized diameters and thread gauges of said squeezable tubes'necks, for tightly securing said paste dispensing device to said squeezable tubes.

7. A method, according to claim 1, wherein said plurality of cap members are color coded, for ensuring sanitary integrity and minimizing the potential for cross-contamination of said paste during use.

8. A method, according to claim 1, wherein said device is comprised of plastic material, for sanitary and long lasting wear.

9. A device for dispensing viscous pastes from conventional squeezable tubes having a threaded cap member, said threaded cap member further comprising a threaded cap top and a threaded neck forming a conduit, said device comprising:

a cylindrically shaped hollow tubular frame, employing a plurality of dispensing cap members having dispensing cap tops attached to dispensing cap necks forming dispensing conduits, said plurality of cap members positioned along the longitudinal axis and lateral axis with respect to the length and of said cylindrically shaped hollow tubular frame, for dispensing said paste;

said cylindrically shaped hollow tubular frame further comprising a threaded connecting conduit centrally positioned along said longitudinal axis of said cylindrically shaped hollow, and opposite said plurality of dispensing cap members; and a threaded connecting cap having an inner and outer threads, wherein said outer threads threadedly attach to said threaded connecting conduit of said cylindrically shaped hollow tubular frame, and said inner threads threadedly attach to said squeezable tube's threaded neck, wherein, when said squeezable tube is squeezed said paste flows;

through said squeezable tube's neck's conduit, through said headed connecting cap's conduit, through said cylindrically shaped hollow tubular frame's threaded connecting conduit, through said cylindrically shaped hollow tubular frame, past said plurality of attached dispensing cap members, towards said desired number of detached dispensing cap members and, out of said desired number of dispensing cap necks' conduits; for dispensing said paste from said dispensing device.

10. A paste dispensing device, according to claim 9, wherein said plurality of dispensing cap members are threaded, for threadedly securing said threaded dispensing cap tops to said threaded dispensing cap necks.

11. A paste dispensing device, according to claim 9, wherein said plurality of dispensing cap members are unthreaded, further comprising unthreaded cap tops and unthreaded cap necks, for friction fitting said unthreaded dispensing cap tops to said unthreaded dispensing cap necks; said unthreaded dispensing cap tops further comprising orbicular lips to enhance said frictional fit.

12. A paste dispensing device, according to claim 11, wherein said unthreaded dispensing cap tops and unthreaded dispensing cap necks are linked by a connecting means, comprising a flexible band, for ensuring that said unthreaded dispensing cap tops shall not be lost.

13. A paste dispensing device, according to claim 9, wherein said dispensing cap necks' conduits having a predetermined circumference for decreasing the dispensed amount of said paste, for economical dispensement of said paste.

14. A paste dispensing device, according to claim 9, wherein said inner threads of said threaded connecting cap having a range of predetermined diameter and thread gauge, for matching various sized diameters and thread gauges of said squeezable tubes, for tightly securing said paste dispensing device to said squeezable tubes.

15. A paste dispensing device, according to claim 9, wherein said plurality of cap members are color coded, for ensuring sanitary integrity and minimizing the potential for cross-contamination of said paste during use.

16. A paste dispensing device, according to claim 9, wherein said device is comprised of plastic material, for sanitary and long lasting wear.

* * * * *